United States Patent [19]

Fuchser

[11] 3,969,730

[45] July 13, 1976

[54] CROSS SLOT OMNIDIRECTIONAL ANTENNA

[75] Inventor: Troy D. Fuchser, Plano, Tex.

[73] Assignee: The United States of America as represented by the Secretary of Transportation, Washington, D.C.

[22] Filed: Feb. 12, 1975

[21] Appl. No.: 549,604

[52] U.S. Cl. ..... 343/770
[51] Int. Cl.[2] ..... H01Q 13/12
[58] Field of Search ..... 343/770, 771

[56] References Cited

UNITED STATES PATENTS 3,002,189 9/1961 Butler ..... 343/771

3,696,433 10/1972 Killion et al. ..... 343/770

*Primary Examiner*—Eli Lieberman
*Attorney, Agent, or Firm*—Otto M. Wildensteiner

[57] ABSTRACT

Disclosed is an omnidirectional antenna comprising vertically stacked pairs of folded slot antennas. Each slot antenna is electrically loaded to allow reduction of slot physical dimensions to the point that the diameter of two slots when mounted back-to-back is less than one wavelength. The resulting antenna produces a highly omnidirectional signal having vertical polarization. Vertical beam shaping is achieved by selection of the phase and magnitude of the signal transmitted by each pair of folded slot elements.

7 Claims, 6 Drawing Figures

CROSS SLOT OMNIDIRECTIONAL ANTENNA

This invention relates to radio frequency antennas and more particularly to omnidirectional radio frequency antennas.

Omnidirectional antennas are used in broadcasting where uniform azimuth coverage is required. Omnidirectional antennas are often used for side-lobe suppression in air traffic control and missile antenna systems. In these latter systems, the strength of a signal received by an omnidirectional antenna is compared to the strength received by a directional antenna having sidelobes. If the directional antenna is receiving a sidelobe signal, the signal strength will be reduced in comparison to the omnidirectional antenna signal strength. In this manner sidelobe signals are identified as such and may be ignored.

Several problems are commonly encountered in the construction of an omnidirectional antenna. A first problem is the interference by the mechanical support and signal feed structure with the omnidirectional pattern. This problem occurs, for example, when a series of vertically stacked simple dipole antennas is used to generate a signal omnidirectional in azimuth but vertically shaped and vertically polarized. If such simple dipole antennas are mounted on a vertical tower the tower and transmission line feeding the individual elements act as reflectors and distort azimuth coverage.

A second problem occurs when a ring of directional antennas is mounted around a support structure to avoid the reflection problem. In such a case, the individual directional antennas are typically spaced more than one-half wavelength apart and the signal transmitted in any given direction is the sum of the signals from more than one antenna. In certain directions the signals will be 180° out of phase and will cancel each other instead of reinforcing. As a result, signal strength varies substantially in the azimuth. The omnidirectionality of such ring antenna structures has been improved by skewing each directional antenna boresight from an angle radial to the support structure. Vertical beam shaping can also be achieved by using a plurality of such antenna ring structures vertically stacked on a supporting structure. The disadvantages of such ring structures are that they are necessarily large and complex, vertical polarization is difficult to achieve, and their large size may interfere with other nearby radiators such as radar scanners.

Another form of omnidirectional antenna is the traveling wave type in which energy for each element is obtained by direct coupling to a main transmission line. The radiating elements are typically dipoles formed by cutting gaps in the outer conductor of a coaxial line. Although such an antenna has good omnidirectional properties and very small diameter, each element interacts strongly with the other elements. One result of the interaction is a lack of independent control of the phase and amplitude of the signal feeding each element which makes modification of vertical beam shape difficult. Another result of the interaction is critical tuning characteristics which make the antenna very narrow band and cause input impedance to vary with weather conditions.

Accordingly, an object of the present invention is to provide an improved omnidirectional antenna.

Another object of the present invention is to provide an omnidirectional antenna having vertical polarization and vertical beam shaping.

Another object of the present invention is to provide an omnidirectional antenna having a diameter of less than one wavelength at the radio frequency to be transmitted.

These and other objects are achieved by providing an array antenna comprising: a plurality of vertically stacked cross-slot radiating elements formed in the walls of a vertical thin-walled hollow structure; power divider and phase shifter means; and means for coupling radio frequency energy from the power divider to the slot radiating elements. The vertical structure has a maximum horizontal dimension of less than one wavelength and provides the mechanical support for the antenna in addition to forming the surface in which slot radiating elements are formed.

Other objects, features and advantages of this invention will become better understood by reference to the following detailed description when read in conjunction with the accompanying drawings wherein.

Figure 3A:
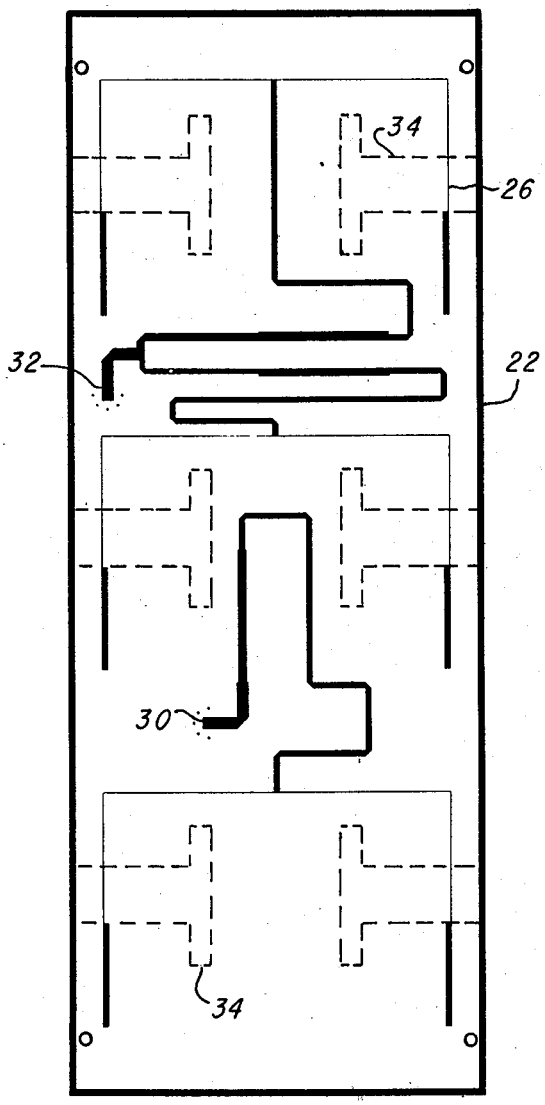
Figure 3C:
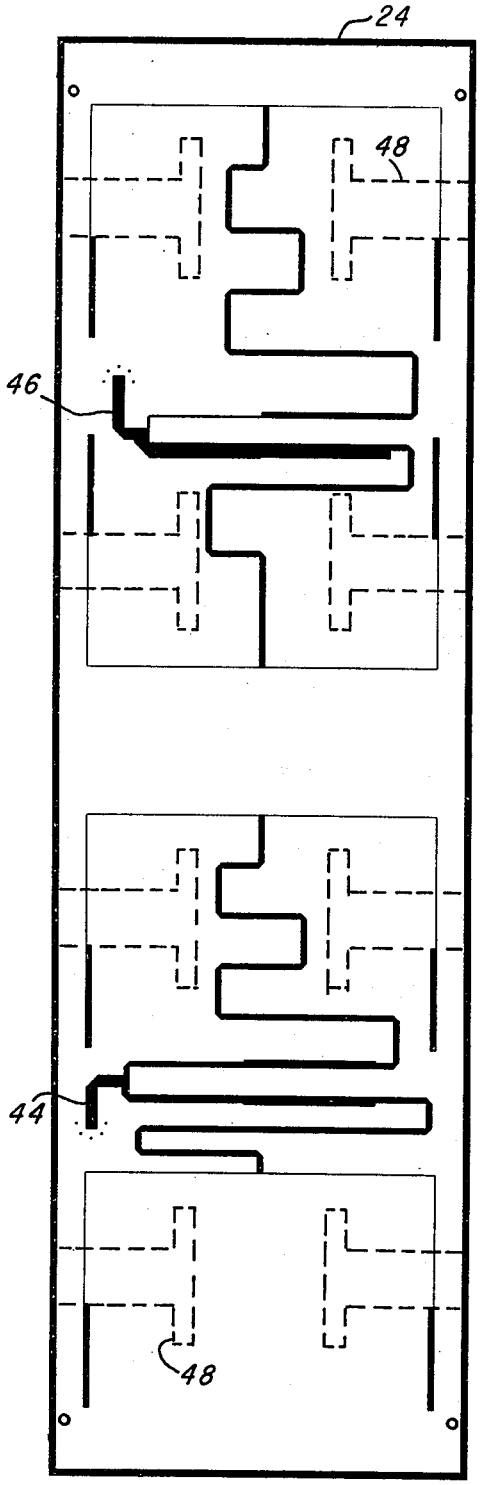
Figure 3B:
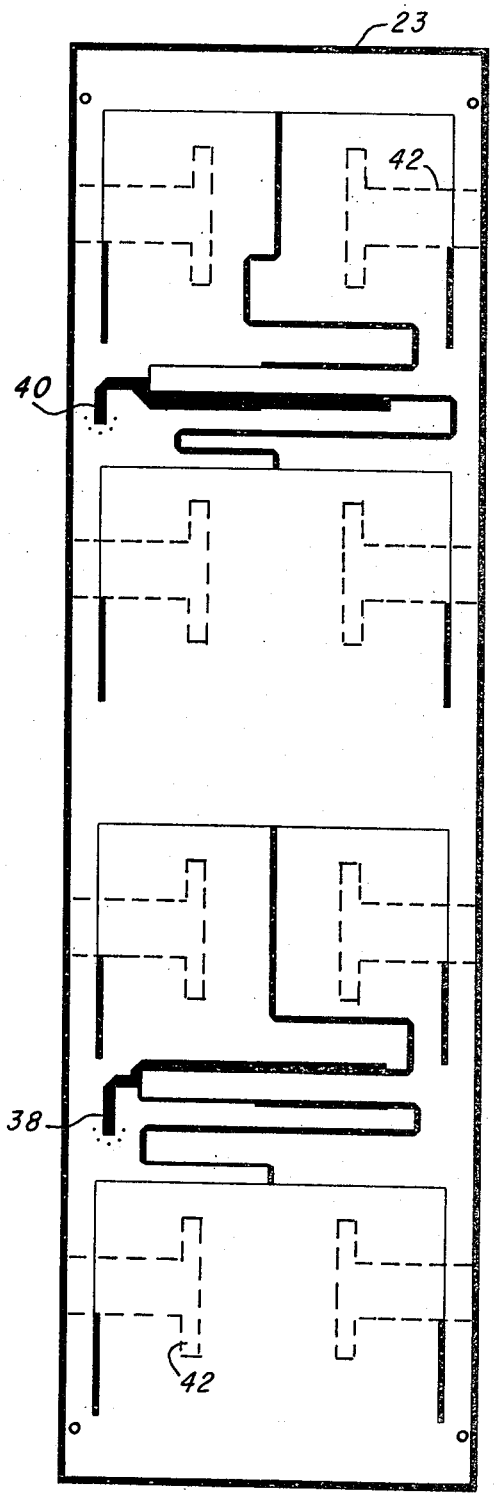

FIGS. 3*a*, 3*b*, and 3*c* illustrate the conductor patterns of strip-line power divider and exciter probe networks and respective ground plane patterns.

Figure 4:
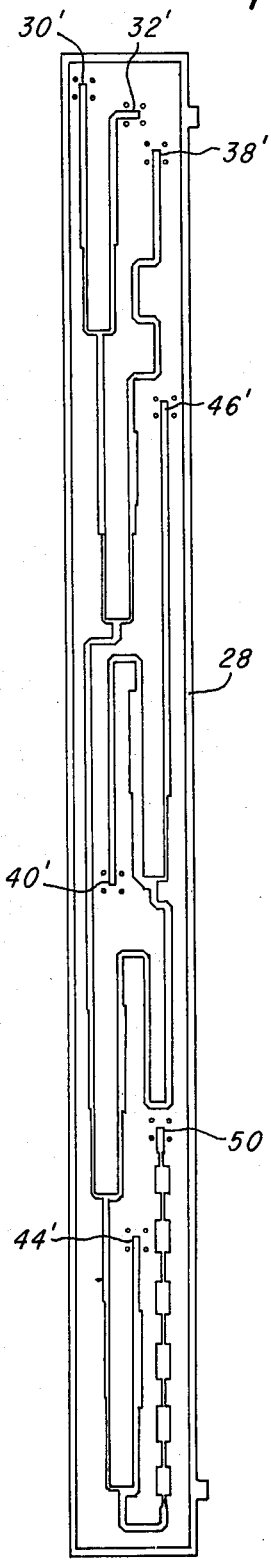

FIG. 4 illustrates the conductor pattern of a strip-line power divider and phase shifter network.

Figure 1:
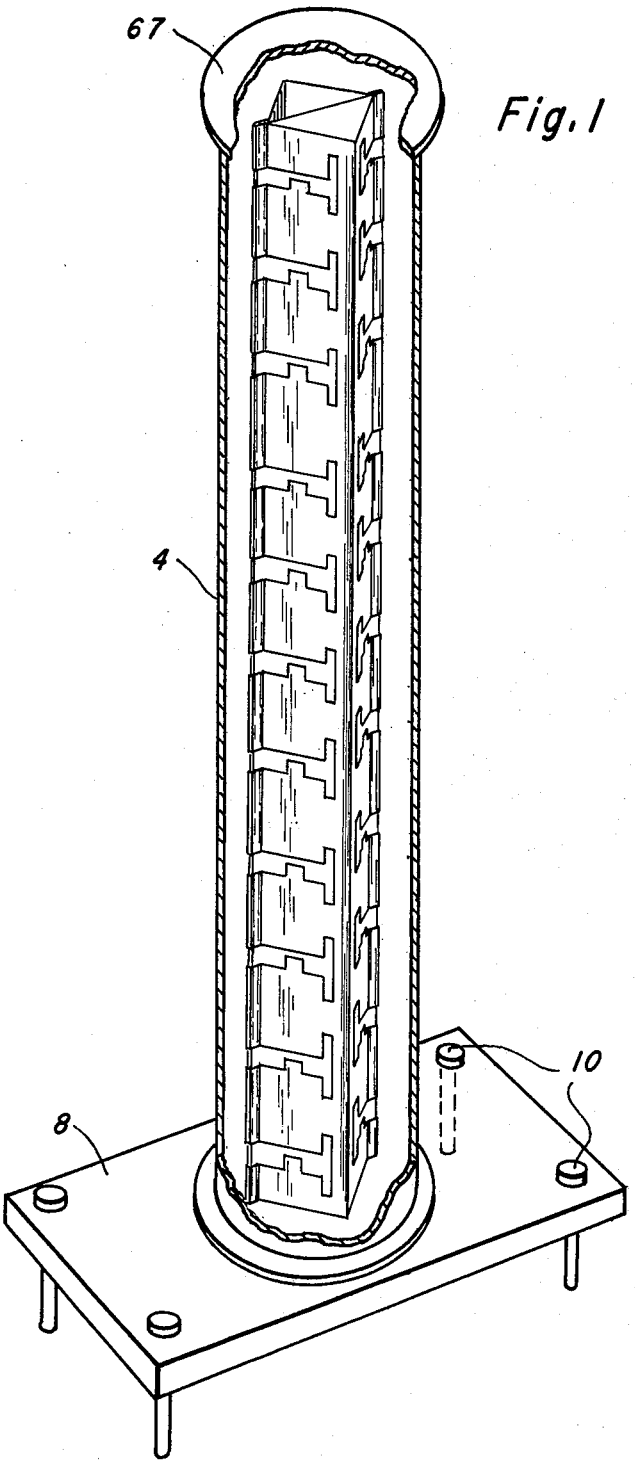
FIG. 1 is an illustration of an antenna according to the present invention mounted in a weatherproof housing.

FIG. 1 illustrates the final assembled form of a preferred embodiment of the present invention. A cross-slot omnidirectional antenna 2 is mounted vertically within a protective fiberglass tube 4. A waterproof cap 67 is attached in sealing relationship to top of tube 4. Antenna 2 and tube 4 both are supported by a baseplate 8. Tube 4 is attached in sealing relationship to baseplate 8 and a waterproof electrical feed-through (not shown) is provided in the center of baseplate 8 for making electrical connection to antenna 2. The antenna assembly may be conveniently mounted to a supporting structure by means of bolts 10 in baseplate 8.

Figure 2:
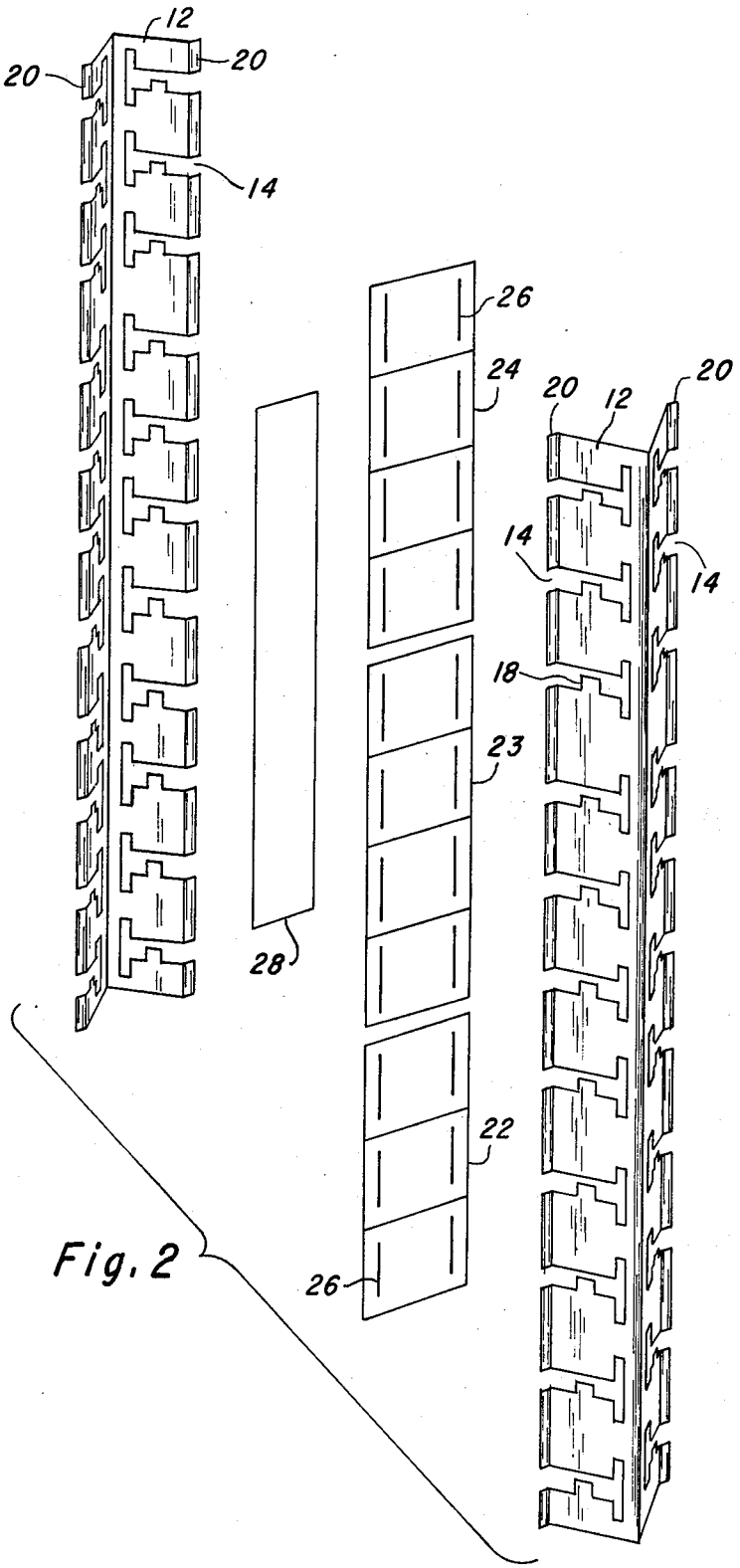
FIG. 2 is an exploded view of an antenna comprising the present invention.

FIG. 2 illustrates in more detail the antenna 2 of FIG. 1. Antenna 2 comprises two sheet metal elements 12, stripline networks 22 through 24 and a stripline network 28. Each element 12 is formed from sheet metal such as aluminum by a machining or stamping process followed by a simple bending operation. The bending operation forms a right angle bend down the center of each element 12 and forms flanges 20 along the long edges of each element 12 and at a 45° angle to the large areas of each element 12. Elements 12 form a ground plane in which slots 14 are formed. The slots 14 are modified by being broadened at their closed ends to form inductive T's 16 and by being narrowed at their centers to form capacitive tabs 18. The inductive T's 16 and capacitive tabs 18 cause the slots 14 to have a nominal electrical length of one-half wavelength while the physical length of the slots is less than one-third wavelength. This loading of the slots allows the overall size of antenna 2 to be reduced so that its maximum horizontal dimension is only 0.56 of a wavelength including the flange length. Each slot 14 mates with identical slot 14 in the opposite ground plane element 12 when the two elements are joined together by bolting the flanges 20 to each other. The pairs of slots 14 form slot radiating elements folded at 90° at their centers. The edges of stripline power divider boards 22, 23, 24 are sandwiched between the mating flanges 20 of the two ground plane elements 12. The stripline networks on each of the power divider boards 22–24 include exciter probes 26 located along the edges of the boards at positions corresponding to the slots 14 in elements 12. When the power divider boards 22–24 are sandwiched between the ground plane elements 12 these exciter probes 26 are thereby located substantially at the center of each folded slot radiating elements. A stripline primary power divider board 28 is mounted within antenna 2 by being bolted to the back of power divider boards 22–24 with ground planes in contact. Stripline board 28 is approximately one-half the width of boards 22–24 and is not sandwiched between the flanges 20 on ground plane elements 12. Primary power divider 28 has one RF power input and provides six RF power outputs. Each of the power divider boards 22–24 receives two of the outputs from primary divider 28. Each of these stripline networks is described in greater detail below.

Although the power divider and phase shifter boards 22–24 and 28 are mounted within the housing formed of the two elements 12, it will be apparent that this is not essential to the present invention. The radiation pattern depends essentially only on the size and shape of elements 12 and slots 14 and the phase and amplitude of the RF energy coupled to each folded slot radiating element.

Power division and phase shifting could be accomplished external to antenna 2 and the signal could be coupled to each radiating element by a separate cable and exciter probe. Although such an arrangement would be more complex than the preferred embodiment, it would allow the use of the electronically adjustable phase shifters or power dividers too large to fit between elements 12.

The good omnidirectional characteristics of the antenna of the present invention are due to the fact that any azimuth direction at a given elevation is exposed to a constant radiating slot area. In other words, a receiver at any azimuth point "sees" the same slot radiating area and therefore receives the same amount of energy. It will therefore be apparent that the square cross section of the hollow ground plane structure formed by bolting the two elements 12 together is not essential to the present invention. Any cross-section shape which provides equal slot exposure in all directions will also provide good omnidirectional radiation. Circular and octagonal cross sections are specific examples and the required cross section can be generally described as four way symmetric. Only the ground plane shell itself has four way symmetry about a vertical axis at the center of the antenna 2. The slots themselves are symmetric about two vertical planes which intersect at the center of antenna 2. One of these symmetry planes passes through the center of each slot radiating element and the other is at a right angle to the first.

FIG. 3a illustrates in detail the stripline network which supplies RF energy to the lowest three pairs of folded slot radiating elements of antenna 2. The ground plane pattern of this stripline network is illustrated by the dashed lines 34. The majority of the ground plane pattern is a solid conductor sheet but slots are formed in this ground plane pattern corresponding in position to the slots in ground plane element 12 and generally of the same shape. These slots are necessary for matching purposes and also to allow energy from the probes 26 to be coupled into both halves 14 of each of the folded slot radiating elements. Stripline board 22 has two inputs 30 and 32. Input 30 receives energy from primary power divider board 28 and divides the energy two ways to provide equal phase and equal power signals to the bottom two folded slot radiating elements. Input 32 also receives RF energy from primary power divider board 28 and this energy is divided four ways to provide RF energy to the second and third pairs of folded slot radiating elements counting from the bottom of the antenna 2. Equal phase and equal power signals are supplied to each of the two radiating elements forming a pair at a given elevation to insure good omnidirectional characteristics; vertical beam shaping is achieved by modifying the power level and phase of RF energy supplied to each pair of radiating elements. This vertical beam shaping accounts for the differences between the power divider networks on each of the boards 22, 23 and 24.

FIG. **3*b* illustrates the conductor pattern of stripline power divider network 23. The ground plane pattern of this board is also illustrated by dashed lines 42 and is essentially the same as that illustrated in FIG. 2*a*. Network 23 has two inputs 38 and 40. Input 38 receives RF power from primary power divider board 28 and divides this energy four ways to supply power to the fourth and fifth pairs of radiating elements of antenna 2 counting from the bottom. Input 40 likewise receives energy from primary divider board 28 and divides this energy four ways to provide RF energy to the sixth and seventh radiating pairs counting from the bottom of the antenna 2.**

FIG. **3*c* illustrates in detail the stripline network of power divider board 24 of FIG. 2. The ground plane pattern of board 24 is illustrated by dashed lines 48 and is again essentially the same as that illustrated in FIG. 3a. Board 24 has two inputs 44 and 46. Input 44 receives energy from primary power divider board 28 and divides this energy four ways to provide outputs for the eighth and ninth pairs of radiating elements counting from the bottom of antenna 2. Input 46 also receives RF energy from primary power divider board 28 and divides this energy four ways to provide power to the tenth and eleventh pairs of radiating elements counting from the bottom of antenna 2.**

FIG. 4 illustrates in detail the conductor pattern of primary powder divider stripline network 28 of FIG. 2. The ground plane pattern of board 28 is not illustrated for clarity since it is simply a solid conductor sheet except for small areas on the opposite side of the input and output points which allow the center conductor of a coaxial connector to be inserted through the board without shorting to the ground plane pattern. Board 28 has a single input 50 for receiving all the RF energy which is to be transmitted by antenna 2. Input 50 is coupled by coaxial cable to the RF feedthrough in the center of base plate 8 illustrated in FIG. 1. All RF energy coupled to input 50 is divided six ways and provided at outputs 30′, 32′, 38′, 40′, 44′ and 46′ which are coupled by coaxial cable to the inputs on divider boards 22–24 having corresponding unprimed designation numbers.

In a typical air traffic control application the antenna 2 is housed in a weather-proof housing as illustrated in FIG. 1 and the unit is mounted on one corner of a surveillance radar antenna support platform. A single coaxial cable coupled to the RF feedthrough in baseplate 8 carries the signal between the antenna and a transmitter/receiver unit in the airport control tower. The operation of antenna 2 is reciprocal so that its reception pattern is identical to its transmission pattern. As discussed above, vertical beam shaping is achieved by proper power division and phase shifting between radiating element pairs. Power division between pairs is fixed by the design of power divider boards 22, 23, 24 and 28 and fixed phase shifts are also inherent in the design of these boards. Part of the total phase shift between input 50 of board 28 and any of the exciter probes 26 is generated by the cables connecting the outputs of board 28 to the respective inputs of boards 22–24. The vertical beam shaping may therefore be adjusted or modified by changing the lengths of these coaxial connecting cables.

As noted above, the maximum horizontal dimension, or diameter, of the preferred embodiment antenna including flanges 20 is 0.56 of a wavelength. The design center frequency is 1.1 gigahertz and corresponding wavelength is 10.7 inches. Tests show that the omnidirectional ripple of this preferred embodiment antenna is less than 2 decibels. The antenna diameter may be increased up to one full wavelength without causing unreasonable increases in the omnidirectional ripple. Such an increase in size would allow the slots 14 to be a full half wavelength long and make slot loading unnecessary. However, such a size increase would also increase the radar cross section of the antenna which must be minimized in air traffic control applications such as that for which the preferred embodiment is designed.

Although the present invention has been shown and illustrated in terms of specific apparatus and circuits, it will be apparent that changes or modifications can be made without departing from the scope of the invention as defined by the appended claims.

What is claimed is:

1. An antenna for radiating radio frequency energy at preselected frequency comprising:

a hollow member having thin conductive walls, said member being four way symmetric about a vertical axis and having a maximum horizontal dimension of less than one wavelength at said preselected frequency, said member having a plurality of horizontal slots having lengths less than two-thirds of a wavelength at said preselected frequency, said slots spaced vertically in two rows, each row centered on a point of maximum horizontal dimension, and said two rows spaced symmetrically about said vertical axis, forming vertically stacked pairs of cross slot radiating elements, power divider means having an input for receiving RF energy at said preselected frequency and one output for each of said slot radiating elements and means for coupling RF energy from said power divider means to said slots to be radiated, whereby said RF energy is radiated in an omnidirectional pattern.

2. An antenna according to claim 1 wherein said power divider means is housed within said hollow member.

3. An antenna according to claim 2 wherein said power divider means is a stripline network.

4. An antenna according to claim 3 wherein said power divider means includes phase shifter means for providing preselected phase shifts to preselected pairs of slot radiating elements, whereby the radiated RF energy is directional in the vertical while remaining omnidirectional in the azimuth.

5. An antenna according to claim 4 wherein the stripline network is rectangular and has a width substantially equal to said maximum horizontal dimension of said hollow member, said network positioned vertically within said hollow member with its edges aligned with the centers of said two rows of slot radiating elements, said network including exciting probes along its edges for coupling RF energy into said slot radiating elements.

6. An antenna for radiating radio frequency energy at a preselected frequency comprising:

four identical rectangular conductive sheets each having a width of less than 0.7 of a wavelength at a preselected frequency, each sheet having a plurality of walls forming a plurality of slots extending from one long edge thereof less than one-half wavelength toward the other long edge, said sheets joined along their long edges at right angles with the slots aligned, to form an open end box structure having a plurality of pairs of folded slot radiating elements, and power dividing means within said box structure having an input for receiving RF energy at said preselected frequency and a plurality of outputs each coupled to one of said folded slot radiating elements for providing portions of said RF energy to each folded slot to be radiated, whereby said RF energy is transmitted in an essentially omnidirectional pattern.

7. An antenna for radiating radio frequency energy at a preselected frequency comprising:

two identical rectangular conductive sheets having a width of less than 1.4 of a wavelength at the preselected frequency, each of said sheets having transverse slots having lengths of less than a wavelength at the preselected frequency, said slots acting as radiating elements, said sheets folded longitudinally at their centers at substantially 90°, said two sheets attached to each other along their edge to form a box shaped structure, radio frequency power divider means having an input for receiving RF power and an output for each slot radiating element in said two sheets, said power divider mounted within the box shaped structure formed by said two sheets, and a plurality of slot driving means within said box shaped structure each coupled to the center of one of said slot radiating elements and to an output of said power divider means for coupling RF power to each slot to be radiated.

* * * * *